US006382410B1

(12) United States Patent
Magid et al.

(10) Patent No.: US 6,382,410 B1
(45) Date of Patent: May 7, 2002

(54) PILL CONTAINER

(76) Inventors: Kenneth M. Magid; Laurel L. Riggs, both of 228 S. McIntyre Way, Golden, CO (US) 80401

( * ) Notice: Subject to any disclaimer, the term of this patent is extended or adjusted under 35 U.S.C. 154(b) by 0 days.

(21) Appl. No.: 09/641,514

(22) Filed: Aug. 21, 2000

(51) Int. Cl.[7] ..... B65D 43/18; B65D 83/04

(52) U.S. Cl. ..... 206/38.1; 206/539; 206/540; 220/525; 220/820; 220/824

(58) Field of Search ..... 206/38.1, 528, 206/533, 534, 538, 539, 540; 220/820–824, 523, 525

(56) References Cited

U.S. PATENT DOCUMENTS

| | | | | | |
|---|---|---|---|---|---|
| 131,069 | A | * | 9/1872 | Shade | 220/823 |
| 975,964 | A | * | 11/1910 | Lee | 220/824 |
| 2,391,347 | A | * | 12/1945 | Punte | 220/821 |
| 2,970,379 | A | * | 2/1961 | Hardgrove | 220/820 |
| 3,111,152 | A | * | 11/1963 | Goessling | 206/38.1 |
| 4,765,459 | A | * | 8/1988 | Edwards | 206/538 |
| 5,887,719 | A | * | 3/1999 | Edwards | 206/538 |

* cited by examiner

*Primary Examiner*—Jim Foster
(74) *Attorney, Agent, or Firm*—Edwin H. Crabtree; Ramuel L. Pizano; Donald W. Margolis

(57) ABSTRACT

A pill container for holding one or more pills and attached to a key chain. The pill container has an overall appearance of an enlarged pill for ease in viewing and quick identification. The pill container includes an open top housing and a housing cover pivotally attached to the housing. The housing includes a bottom and an upwardly extending housing ring attached to the bottom of the housing. The housing can include one or more individual open top pill rings for holding individual pills apart from other pills. The pill rings are dimensioned for holding different size pills. Also, the housing may include an outwardly extending key chain ear attached to a portion of the housing ring. The ear is adapted for receiving a portion of a key chain. Further, the housing includes a post sleeve and a knob sleeve. The housing cover includes a top and a bottom portion. The bottom portion engages an edge of the housing ring when the housing cover is in a closed position on the open top housing. Also, the cover includes a downwardly extending vertical post and knob. The vertical post is dimensioned to be received in the top of the post sleeve in a press fit. The post is used as a hinge pin for pivoting the cover on top of the open top housing. The knob is dimensioned to be received in the top of the knob sleeve in a snap fit for holding the cover in a closed position on the housing.

15 Claims, 2 Drawing Sheets

PILL CONTAINER

BACKGROUND OF THE INVENTION (a) Field of the Invention

This invention relates to a pill container and more particularly, but not by way of limitation, to a container for holding one or more aspirin and/or other pill medication. The container is adapted for attachment to a key chain and like items or can be carried apart from a key chain.

(b) Discussion of Prior Art

Heretofore, there have been a number of different types of pill containers, dispensers and carriers for holding and dispensing different types of pill medication. In U.S. Pat. No. 3,638,830 to Belokin, Jr., a pocket-size pill box is described. The pill box includes a flat disc-shaped cover rotatably mounted on a pill compartment. The dispenser is designed to release a selected pill one at a time from a central pill compartment holding a plurality of pills. U.S. Pat. No. 3,561,592 to McCool discloses another type of pill dispenser having individual compartments for each pill along with designated times for taking each pill. U.S. Pat. No. 6,068,126 to Dejonge describes a pill pack for holding a number of pills and with a closed-biased cover. The cover includes a gate which opens and closes for permitting pill movement during the movement of the cover. U.S. Pat. No. 4,765,460 to Pacheco discloses a key ring and pill holder container for carrying both keys and pills. U.S. Pat. No. 4,903,860 to Leopoldi et al. describes a pill dispenser for holding nitroglycerine pills. The dispenser is worn around the neck for quick access to the pills. Also, U.S. Patent Des. 409,830 to Staffore illustrates a new design of a key ring pill container.

None of the above mentioned patents describe or teach individually or in combination the unique features, advantages, structure and function of the subject pill container described herein.

SUMMARY OF THE INVENTION

In view of the foregoing, it is a primary object of the subject invention to provide a pill container for mounting on a key chain, mounting on other types of carriers or carried by itself. The pill container has an overall appearance of an enlarged pill for ease in viewing and quick identification.

Another object of the invention is the pill container is easy to operate for quick access to the pills stored therein. A plurality of pills can be stored inside the container or the container can include individual compartments for holding each pill apart from another pill. The individual compartments are dimensioned for receiving different size pills.

Yet another object of the pill container is the use of a housing cover which pivots on top of a pill housing for providing limited access or full access to the housing when removing one or more pills stored therein.

The container includes broadly an annular open top housing and an annular housing cover pivotally attached to the housing for opening and closing on top of the housing. The housing includes an annular shaped bottom and an upwardly extending housing ring. A lower portion of the ring is attached to a circumference of the bottom of the housing. The housing can also include one or more individual open top pill rings for holding individual pills apart from other pills. The pill rings are dimensioned for holding different size pills.

Also, the housing may include an outwardly extending key chain ear attached to a portion of the housing ring. The key chain ear includes an opening therethrough. The opening is adapted for receiving a portion of a key chain. A top portion of the key ring ear extends above an upper edge of the housing ring. The top portion of the ear includes a groove therein for receiving an outwardly extending close flange. The close flange and an open flange are disposed in a circumference of the housing cover.

Further, the housing includes a post sleeve and a knob sleeve. A lower end of the sleeves is attached to the bottom of the housing. The two sleeves are disposed on opposite sides of the bottom of the open top housing.

The housing cover includes a curved dome-shaped top portion and a flat horizontal bottom portion. The flat horizontal bottom portion engages an upper edge of the housing ring when the housing cover is in a closed position on top of the open top housing. In one side of the bottom portion of the cover is a downwardly extending vertical post. The vertical post is dimensioned to be received in the top of the post sleeve in a press fit. The post is used as a hinge pin for pivoting the cover on top of the open top housing. In an opposite side of the bottom portion of the cover is a downwardly extending knob. The knob is used for receipt in the top of the knob sleeve in a snap fit. The knob helps hold the cover in a closed secure position on top of the open top housing.

These and other objects of the present invention will become apparent to those familiar with different types and designs of pill containers and pill dispensers when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
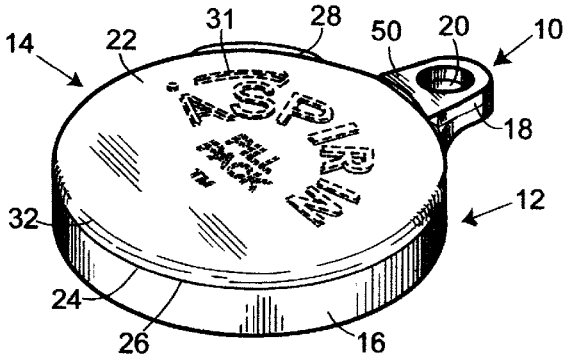
FIG. 1 is a perspective view of the subject pill container. In this view, an annular shaped housing cover is shown in a closed position on top of an annular open top housing. The housing includes a housing ring with an outwardly extending ear. The ear includes a key chain opening therethrough. The opening is adapted for receiving a portion of a key chain therethrough.

In FIG. 1, a perspective view of the subject pill container is shown and having general reference numeral 10. Broadly the pill container 10 includes an annular open top housing, having general reference numeral 12, and an annular housing cover 14, having general reference numeral 14. In this view, the annular shaped housing cover 14 is shown in a closed position on top of an annular open top housing 12.

The housing 12 includes a housing ring 16 with an outwardly extending ear 18 formed in a side of the ring 16. The ear 18 includes a key chain opening 20 therethrough. The opening 20 is adapted for receiving a portion of a key chain therethrough. A key chain is not shown in the drawings. While the ear 18 and key chain opening 20 are discussed herein for receiving a key chain therethrough, it can be appreciated that the subject pill container 10 can be used equally well without the use of the ear 18 and the opening 20 without departing from the spirit and scope of the invention.

The housing cover 14 includes a curved dome-shaped top portion 22 and a flat bottom portion 24. The flat bottom portion 24 is more clearly seen in FIGS. 6 and 7. The flat bottom portion 24 engages all of an upper edge 26 of the housing ring 16 when the housing cover 14 is in a completely closed position on top of the open top housing 12 as shown in FIG. 1. Also, the housing cover 14 includes an open flange 28 and a close flange 30. The two flanges 28 and 30 are spaced apart and extend outwardly from a circumference 32 of the housing cover 14 only the open flange 28 is shown in FIG. 1. Both of the flanges 28 and 30 are shown clearly in FIGS. 2–7.

It should be noted that the pill container 10 is shown with the products brand name "ASPIRIN PILL BACKS " in dashed lines on the top portion 22 of the cover 14. Also, an arrow 31 is shown on the top portion 22 for helping the user on the correct direction of opening the cover 14 on the open top housing 12.

Figure 2:
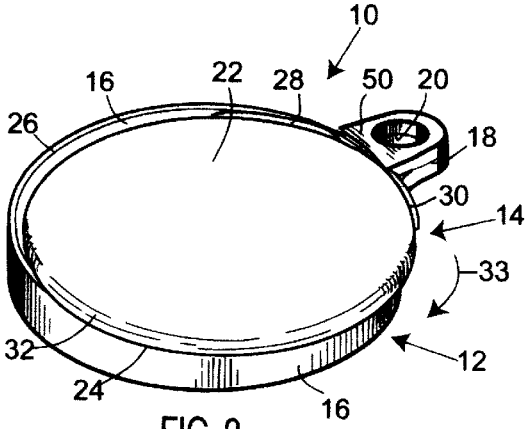
FIG. 2 is another perspective view of the pill container with the housing cover pivoted in a clockwise direction for opening slightly the open top housing.

In FIG. 2, the pill container 10 is shown with the housing cover 14 pivoted in a clockwise direction, as indicated by arrow 32. When opening the pill container 10, for example, the user holds the ear 18 or a portion of the open top housing 12 with one hand. With the other hand, the user grips the sides of the cover 14 and using the first flange 28 pivots the cover in a clockwise direction thereby opening the cover as shown in FIGS. 2–5.

Figure 3:
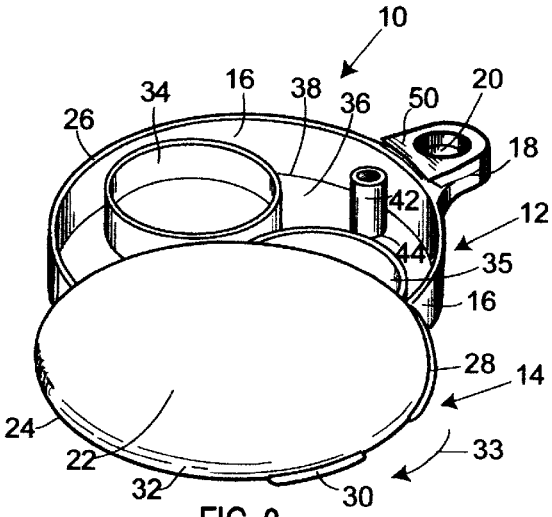
FIG. 3 is still another perspective view of the pill container with the housing cover pivoted in the clockwise direction and half opening the top of the open top housing. In this view, the open top housing is shown with two individual pill rings for holding individual pills.

In FIG. 3, another perspective view of the pill container 10 is shown. In this drawing, the housing cover 14 has been pivoted for opening half of the top of the open top housing 12. The open top housing 12 is shown with a first open top individual pill ring 34 and a second open top individual pill ring 35. The pill rings 34 and 35 are attached to a bottom 36 of the housing 12. The pill rings 34 and 35 are dimension for receiving different size pills and for holding the pills separately from other pills stored inside the housing 12. The pills are not shown in the drawings. Also, in this drawing, a lower edge 38 of the housing ring 16 is shown attached to a circumference of the bottom 26 of the housing 12. While the two pill rings 34 and 35 are shown in FIGS. 3 and 4, it can be appreciated that only one pill ring can be used or any number of pill rings can be used with the pill container 10.

With the cover 14 half open on the housing 12, it can be seen that the top of the first pill ring 34 has been completely exposed for allowing a pill stored therein to be removed. But it should be mentioned that in this drawing, the second pill ring 35 is still partially covered by the housing cover 14 to prevent the removal of a pill from this pill ring. When the cover 14 is half open as shown, the cover 14 has been pivoted in a range of 40 to 50 degrees on the housing 12.

The housing 12 also includes a post sleeve 40 and a knob sleeve 42. A lower end 44 of the sleeves 40 and 42 is attached on opposite sides of the bottom 36 of the housing 12. The post sleeve 40 is shown in FIG. 7 and in dotted lines in FIG. 6.

Figure 4:
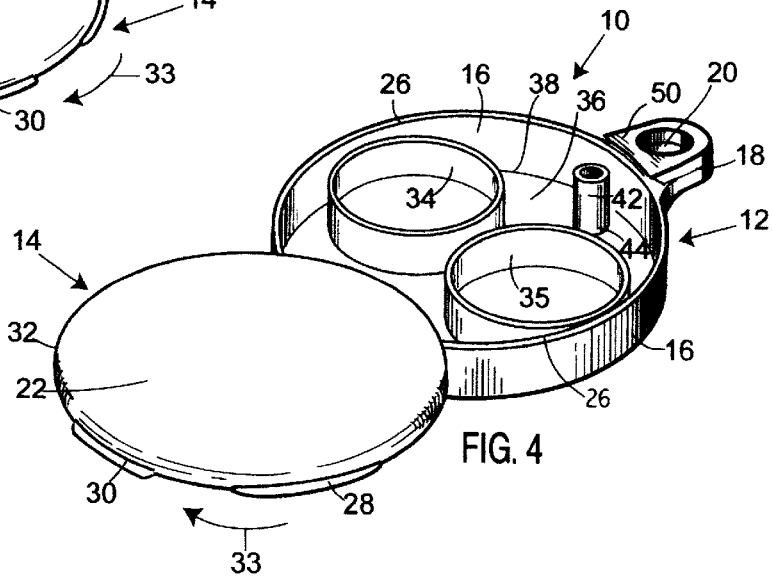
FIG. 4 is a perspective view similar to FIG. 3 but with the housing cover in a fully open position on top of the open top housing.

In FIG. 4, a perspective view similar to FIG. 3 is shown. In this drawing, the housing cover 14 is in a fully open position on top of the open top housing 12. At this time, both of the open top pill rings 34 and 35 are completely exposed and pills stored therein can now be easily removed. When the cover 14 is completely open as shown, the cover 14 has been pivoted in a range of 170 to 180 degrees on the housing 12.

Figure 5:
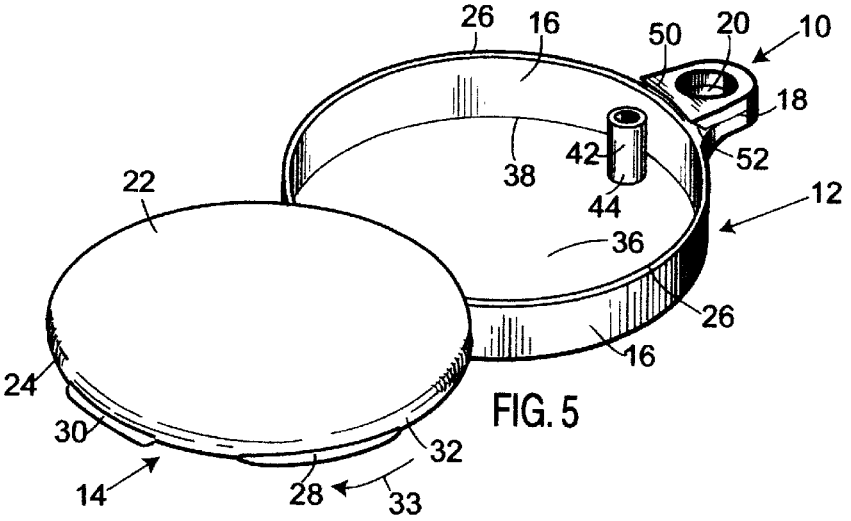
FIG. 5 is similar to the perspective view of the pill container shown in FIG. 4 but without individual pill rings in the open top housing.

In FIG. 5, a perspective view similar to FIG. 4 is illustrated with the housing cover 14 completely open. In this example, the pill container 10 is shown without one or more individual pill rings attached to the bottom 36 of the open top housing 12. Obviously, this embodiment of the container 10 can be used for storing any number of pills, but without the benefit of keeping the pills separated from each other during storage.

Figure 6:
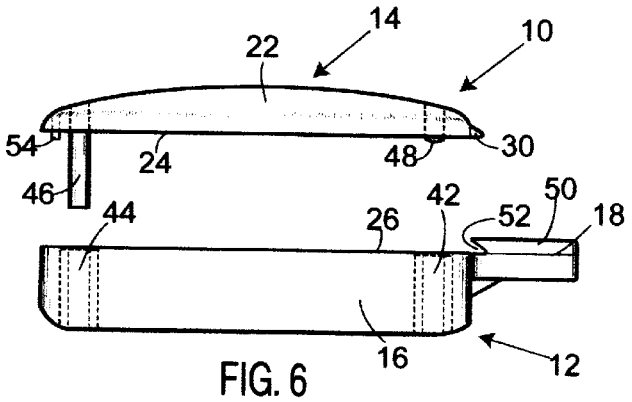
FIG. 6 is a side view of the pill container with the annular housing cover disposed above the open top housing.
Figure 7:
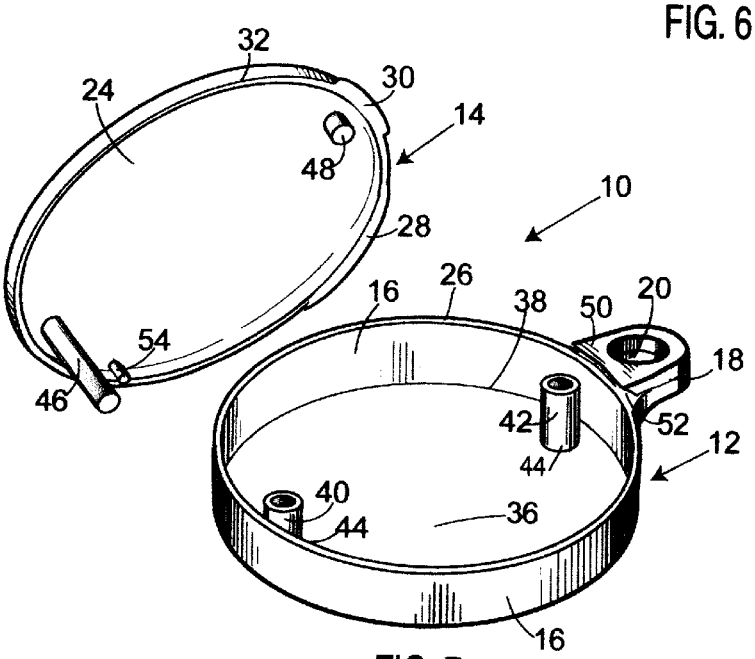
FIG. 7 is a perspective view of the pill container and illustrating a view of the flat bottom portion of the housing cover. The cover having a vertical pivot post and a knob on opposite sides of the bottom portion.

In FIG. 6, a side view of the pill container 10 is shown. In this drawing, the annular housing cover 14 is removed from the housing 12 and disposed above housing. In one side of the bottom portion 24 of the cover 14 is a downwardly extending vertical post 46. The vertical post 46 is dimensioned to be received in the top of the post sleeve 44 in a press fit. The post sleeve 44 is shown in dotted lines. The post 46 acts as a hinge pin for pivoting the cover 14 on top of the open top housing 12 as shown in the above mentioned drawings. In an opposite side of the bottom 36 of the cover 14 is a downwardly extending knob 48. The knob 48 is used for receipt in the top of the knob sleeve 42 in a snap fit. The knob sleeve 42 is shown in dotted lines. The snap fit of the knob 48 helps hold the cover 14 in a closed position securely on top of the open top housing 12.

In this drawing, a top portion 50 of the ear 18 extends above the upper edge 26 of the housing ring 16. The top portion 50 includes a flange groove 52 next to the upper edge 26. The flange groove 52 is used for receiving the close flange 30 therein, as shown in FIG. 1. The flange groove 52 and the close flange 30 help insure that the cover 22 stays in a closed position when the pill container 10 is carried on a key chain.

In FIG. 7, a perspective view of the pill container 10 is illustrated with the cover 14 removed from the open top housing 12. In this drawing, a view of the flat bottom portion 24 of the housing cover 14 is shown with the vertical pivot post 46 and the knob 48 on opposite sides of the bottom portion 24.

Also shown in the drawing is a small post stop 54 attached to the bottom portion 24 of the cover 14. The post stop 54 is positioned next to the pivot post 46 and acts to prevent the cover 14 from pivoting more than 180 degrees on top of the housing 12. For example, in FIGS. 4 and 5, when the cover 14 is pivoted up to 180 degrees, the post stop 46 engages a portion of the inner circumference of the housing ring 16, thus limiting the travel of the cover 14.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A key chain pill container for holding one or more aspirin and/or medication pills, the container adapted for receipt on a portion of a key chain, the pill container comprising:

a circular open top housing, said housing having a circular shaped bottom and an upwardly extending housing ring, a lower portion of said housing ring attached to a circumference of the bottom of said housing, said housing having a post sleeve, a lower end of the post sleeve attached to the bottom of said housing;

a circular housing cover pivotally attached to said housing for opening and closing on top of said housing, a flat bottom portion of said cover completely engaging a circumference of an upper edge of said housing ring when said cover is in a closed position on top of said housing, the bottom portion of said cover having a downwardly extending vertical post, said vertical post dimensioned to be received in the top of said post sleeve in a press fit, said post used as a hinge pin for pivoting said cover on top of said housing;

means for releasably securing said cover on said housing in a closed position; and key ring engagement means, said key ring engagement means attached to a side of said housing ring and adapted for receipt around a portion of the key chain.

2. The container as described in claim 1 further including a first open top pill ring and a second open top pill ring mounted on the bottom of said housing, said first and second pill rings dimensions for receiving individual pills therein.

3. The container as described in claim 1 wherein said means for releasably securing said cover on said housing is a knob mounted on the flat bottom portion of said cover, said knob disposed on an opposite side of the bottom portion from said pivot post, said knob engaging a top of a knob sleeve attached to the bottom of said housing, said knob engaging said knob sleeve in a snap fit when said cover is closed on top of said housing.

4. The container as described in claim 1 wherein said key ring engagement means is a key chain ear extending outwardly from said housing ring, said ear having a key chain opening therethrough, said key chain opening adapted for receiving a portion of the key chain therethrough, said key chain ear having a flange groove therein.

5. The container as described in claim 3 wherein said cover has an outwardly extending close flange, said close flange received in said flange groove when said cover is closed on top of said housing, said close flange extending outwardly from a circumference of said cover.

6. The container as described in claim 3 wherein said cover includes a open flange extending outwardly from a circumference of said cover, said open flange used for pivoting said cover into an open position on top of said housing.

7. The container as described in claim 3 wherein said cover includes a post stop extending downwardly from the bottom portion of said cover, said post stop disposed next to said vertical post, said post stop engaging a portion of said housing ring when said cover is opened on the top of said housing.

8. A key chain pill container for holding one or more aspirin and/or medication pills, the container adapted for receipt on a portion of a key chain, the pill container comprising:

a circular open top housing, said housing having a circular shaped bottom and an upwardly extending housing ring, a lower portion of said housing ring attached to a circumference of the bottom of said housing, said housing having a post sleeve and a knob sleeve, a lower end of said sleeves attached to opposite sides of the bottom of said housing;

a circular housing cover pivotally attached to said housing for opening and closing on top of said housing, a flat bottom portion of said cover completely engaging a circumference of an upper edge of said housing ring when said cover is in a closed position on top of said housing, the bottom portion of said cover having a downwardly extending vertical post and knob post, said vertical post dimensioned to be received in the top of said post sleeve in a press fit, said post used as a hinge pin for pivoting said cover on top of said housing, said knob post engaging a top of said knob sleeve in a snap fit when said cover is closed on top of said housing; and a key chain ear extending outwardly from said housing ring, said ear having a key chain opening, said key chain opening therethrough, said key chain opening adapted for receiving a portion of the key chain therethrough.

9. The container as described in claim 8 further including a plurality of pill rings mounted on the bottom of said housing, said pill rings dimensions for receiving individual pills therein.

10. The container as described in claim 8 wherein said cover has an outwardly extending close flange, said close flange received in a flange groove in a side of said key chain ear when said cover is closed on top of said housing, said close flange extending outwardly from a circumference of said cover.

11. The container as described in claim 8 wherein said cover includes a open flange extending outwardly from the circumference of said cover, said open flange used for pivoting said cover into an open position on top of said housing.

12. The container as described in claim 8 wherein said cover includes a post stop extending downwardly from the bottom portion of said cover, said post stop engaging a portion of said housing ring when said cover is opened and pivoted in a range of 170 to 180 degrees on the top of said housing.

13. A pill container for holding one or more aspirin and/or medication pills, the pill container comprising:

a circular open top housing, said housing having a circular shaped bottom and an upwardly extending housing ring, a lower portion of said housing ring attached to a circumference of the bottom of said housing;

a circular housing cover pivotally attached to said housing for opening and closing on top of said housing, a flat bottom portion of said cover completely engaging a circumference of an upper edge of said housing ring when said cover is in a closed position on top of said housing;

a key chain ear extending outwardly from said housing ring, said ear having a key chain opening, said key chain opening adapted for receiving a portion of a key chain therethrough, said key chain ear including a top portion having a flange groove therein, said flange groove receiving an outwardly extending close flange when said cover is closed on top of said housing, said close flange extending outwardly from a circumference of said cover; and means for releasably securing said cover on said housing in a closed position.

14. The container as described in claim 13 further including at least one open top pill ring mounted on the bottom of said housing, said pill ring dimensioned for receiving an individual pill therein.

15. The container as described in claim 13 wherein said means for releasably securing said cover on said housing is a knob mounted on the flat bottom portion of said cover, said knob engaging a top of a knob sleeve attached to the bottom of said housing, said knob engaging said knob sleeve in a snap fit.

* * * * *